US009399302B2

(12) United States Patent
Shimizu et al.

(10) Patent No.: US 9,399,302 B2
(45) Date of Patent: Jul. 26, 2016

(54) ELECTRIC SHAVER

(71) Applicant: PANASONIC CORPORATION, Osaka (JP)

(72) Inventors: Hiroaki Shimizu, Hikone (JP); Hiroshi Shigeta, Fujiidera (JP); Shin Hosokawa, Hikone (JP); Jyuzaemon Iwasaki, Nagahama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 211 days.

(21) Appl. No.: 14/103,017

(22) Filed: Dec. 11, 2013

(65) Prior Publication Data

US 2014/0165406 A1 Jun. 19, 2014

Related U.S. Application Data

(62) Division of application No. 12/649,447, filed on Dec. 30, 2009, now Pat. No. 8,627,574.

(30) Foreign Application Priority Data

Jan. 15, 2009 (JP) ..... 2009-006273

(51) Int. Cl.
*B26B 19/04* (2006.01)

(52) U.S. Cl.
CPC ..... *B26B 19/048* (2013.01)

(58) Field of Classification Search
CPC ..... B26B 19/02; B26B 19/04; B26B 19/044; B26B 19/046; B26B 19/048; B26B 19/063; B26B 19/146
USPC ..... 30/42, 43.7–46, 527
See application file for complete search history.

(56) References Cited

U.S. PATENT DOCUMENTS

| | | | |
|---|---|---|---|
| 4,797,997 | A | 1/1989 | Packham et al. |
| 4,922,608 | A | 5/1990 | Pahl |
| 4,930,217 | A | 6/1990 | Wolf et al. |
| 5,159,755 | A | 11/1992 | Jestadt et al. |

(Continued)

FOREIGN PATENT DOCUMENTS

| | | |
|---|---|---|
| CN | 101885185 | 4/2012 |
| EP | 1405701 | 4/2004 |

(Continued)

OTHER PUBLICATIONS

Notice of Opposition to European Patent No. 2208589, Nov. 15, 2012.

(Continued)

*Primary Examiner* — Jason Daniel Prone
(74) *Attorney, Agent, or Firm* — Greenblum & Bernstein P.L.C.

(57) ABSTRACT

An electric shaver includes a rod-shaped body part, a head part, and an interposer. The head part projects from one end portion, in a longitudinal direction, of the body part and swingably attached to the body part. The head part includes a shaving portion and a drive mechanism. The interposer is configured to support the head part swingably about a first swing axis parallel with a longitudinal direction of the shaving portion, and to be supported on the body part swingably about a second swing axis orthogonal to the projecting direction of the head part and orthogonal to the first swing axis.

9 Claims, 9 Drawing Sheets

(56) References Cited

U.S. PATENT DOCUMENTS

| | | | | |
|---|---|---|---|---|
| 5,704,126 | A | 1/1998 | Franke et al. | |
| 5,706,582 | A | 1/1998 | Hosokawa et al. | |
| 6,098,289 | A | 8/2000 | Wetzel et al. | |
| 6,115,924 | A | 9/2000 | Oldroyd | |
| 6,226,871 | B1 | 5/2001 | Eichhorn et al. | |
| 6,357,117 | B1 | 3/2002 | Eichhorn et al. | |
| 6,357,118 | B1 | 3/2002 | Eichhorn et al. | |
| 6,559,563 | B1 | 5/2003 | Shimizu et al. | |
| 6,892,457 | B2 * | 5/2005 | Shiba | B26B 19/048 30/43.92 |
| 6,946,756 | B2 | 9/2005 | Shimizu et al. | |
| 6,991,217 | B2 | 1/2006 | Shimizu et al. | |
| 7,017,270 | B2 * | 3/2006 | Shiba | B26B 19/048 30/43.92 |
| 7,020,966 | B2 * | 4/2006 | Shiba | B26B 19/046 30/43.92 |
| 7,162,801 | B2 | 1/2007 | Royle | |
| 7,302,759 | B2 * | 12/2007 | Oh | B26B 19/048 30/43.92 |
| 7,334,338 | B2 * | 2/2008 | Shiba | B26B 19/04 30/43.92 |
| 7,461,456 | B2 | 12/2008 | Tsushio et al. | |
| 7,730,621 | B2 | 6/2010 | Komori et al. | |
| 7,739,798 | B2 | 6/2010 | Iwasaki et al. | |
| 7,832,104 | B2 | 11/2010 | Yamasaki et al. | |
| 7,841,090 | B2 | 11/2010 | Eichhorn et al. | |
| 8,011,102 | B2 | 9/2011 | Sato et al. | |
| 8,181,349 | B2 | 5/2012 | Sagawa et al. | |
| 8,479,397 | B2 * | 7/2013 | Sato | B26B 19/046 30/43.92 |
| 8,627,574 | B2 * | 1/2014 | Shimizu | B26B 19/048 30/42 |
| 8,806,763 | B2 * | 8/2014 | Shiba | B26B 19/04 30/43.92 |
| 2003/0094861 | A1 | 5/2003 | Shimizu et al. | |
| 2004/0128834 | A1 | 7/2004 | Royle | |
| 2004/0231160 | A1 | 11/2004 | Shiba et al. | |
| 2004/0237310 | A1 | 12/2004 | Shiba et al. | |
| 2005/0138821 | A1 | 6/2005 | Tsushio et al. | |
| 2007/0022607 | A1 | 2/2007 | Takeuchi et al. | |
| 2007/0261249 | A1 | 11/2007 | Yamasaki et al. | |
| 2008/0034591 | A1 | 2/2008 | Fung | |
| 2008/0282576 | A1 | 11/2008 | Ueda et al. | |
| 2008/0307653 | A1 | 12/2008 | Wattam | |
| 2009/0025229 | A1 * | 1/2009 | Kappes | G01W 1/14 30/43.92 |
| 2009/0241343 | A1 | 10/2009 | Yamasaki et al. | |
| 2010/0175259 | A1 | 7/2010 | Shigeta et al. | |
| 2010/0175260 | A1 | 7/2010 | Shigeta et al. | |
| 2010/0175262 | A1 | 7/2010 | Shigeta et al. | |
| 2010/0175263 | A1 | 7/2010 | Shimizu et al. | |
| 2010/0180448 | A1 | 7/2010 | Sato et al. | |
| 2011/0094107 | A1 | 4/2011 | Ring et al. | |
| 2011/0179648 | A1 | 7/2011 | Sakon et al. | |
| 2011/0232097 | A1 | 9/2011 | Iwasaki et al. | |
| 2011/0232098 | A1 | 9/2011 | Kobayashi et al. | |
| 2012/0005899 | A1 | 1/2012 | Takaoka et al. | |
| 2012/0005900 | A1 * | 1/2012 | Erndt | B26B 19/04 30/43.92 |
| 2012/0074796 | A1 | 3/2012 | Kobayashi et al. | |
| 2012/0151773 | A1 | 6/2012 | Iwasaki et al. | |
| 2012/0151774 | A1 | 6/2012 | Shimizu et al. | |
| 2012/0216409 | A1 | 8/2012 | Shigeta et al. | |
| 2013/0104402 | A1 * | 5/2013 | Yamasaki | B26B 19/288 30/43.91 |

FOREIGN PATENT DOCUMENTS

| | | |
|---|---|---|
| EP | 1547735 | 6/2005 |
| EP | 1854593 | 11/2007 |
| EP | 1935585 | 6/2008 |
| EP | 2208589 | 2/2012 |
| GB | 2266070 | 10/1993 |
| JP | 6-343776 | 12/1994 |
| JP | 2002-315978 | 10/2002 |
| JP | 2005-192615 | 7/2005 |
| JP | 2006-042897 | 2/2006 |
| JP | 2007-89698 | 4/2007 |
| JP | 2010-162135 | 7/2010 |
| WO | 2007037251 | 4/2007 |
| WO | 2010/000352 | 1/2010 |

OTHER PUBLICATIONS

Japan Office action, mail date is Sep. 13, 2011 w/English language translation.

Russia Office action, dated Oct. 2010 with English translation thereof.

Japan Office Action dated Jan. 25, 2011.

* cited by examiner

ELECTRIC SHAVER

CROSS REFERENCE TO RELATED APPLICATIONS

The present application is a division of U.S. application Ser. No. 12/649,447, now U.S. Pat. No. 8,627,574, filed Dec. 30, 2009, the disclosure of which is incorporated herein by reference in its entirety.

This application is based upon and claims the benefit of priority from the prior Japanese Patent Application No. 2009-006273, filed on Jan. 15, 2009, the entire contents of which are incorporated herein by reference.

BACKGROUND OF THE INVENTION

1. Field of the Invention

The present invention relates to an electric shaver.

2. Description of the Related Art

Japanese Patent Application Laid-Open Publication No. Hei 6-343776 discloses an electric shaver in which a head part having elongated shaving portions is attached to a tip portion of an approximately rod-shaped body part swingably about two swing axes mutually orthogonal to each other. Each of the two swing axes is approximately orthogonal to a projecting direction of the head part. In addition, one of the two swing axes is parallel with a longitudinal direction of the shaving portions, and the other is orthogonal to the longitudinal direction.

SUMMARY OF THE INVENTION

In this electric shaver, the two swing axes are located close to each other. Thus, the head part easily swings about the swing axis orthogonal to the longitudinal direction of the shaving portions due to a long moment arm, but has a difficulty in swinging about the swing axis parallel with the longitudinal direction of the shaving portions due to a short moment arm. Because of such swing characteristics of the head part, it is difficult to exert a good following performance of the head part to follow an uneven shaving area, such as the cheeks, chin, or neck. Thereby, the shaving performance may possibly be low.

An object of the present invention is thus to provide an electric shaver including a head part capable of exerting a higher following performance on an uneven shaving area.

An aspect of the present invention is an electric shaver comprising: a rod-shaped body part; a head part projecting from one end portion, in a longitudinal direction, of the body part and swingably attached to the body part, the head part including a shaving portion and a drive mechanism, the shaving portion formed to be elongated in a direction orthogonal to a projecting direction of the head part and having paired blades configured to operate relative to each other, the drive mechanism configured to drive at least one of the paired blades; and an interposer configured to support the head part swingably about a first swing axis parallel with a longitudinal direction of the shaving portion, and to be supported on the body part swingably about a second swing axis orthogonal to the projecting direction of the head part and orthogonal to the first swing axis, wherein the second swing axis is located farther away from a tip portion, in the projecting direction, of a contact surface of the shaving portion to be brought into contact with a shaving area, than the first swing axis is.

According to the aspect, the second swing axis is located farther away from the tip portion, in the projecting direction, of the contact surface of the shaving portion, than the first swing axis is, the contact surface being to be brought into contact with the shaving area. Thus, when the head part swings about the second swing axis, the contact surface moves (slides) a longer distance along the shaving area, which increases the swing resistance. Specifically, when the head part swings about the second swing axis, the swing torque becomes larger as the moment arm becomes longer; however, the swing load torque can be increased by the slide resistance, thereby preventing the head part from swinging easily only about the second swing axis. Consequently, an improved following performance of the head part on the shaving area can be exerted.

The electric shaver may further comprise: a first link mechanism including two first link arms each connected to the interposer and the head part respectively at first connecting axes parallel with the longitudinal direction of the shaving portion, the first link mechanism configured to support the head part on the interposer swingably about the first swing axis; and a second link mechanism including two second link arms each connected to the body part and the interposer respectively at second connecting axes orthogonal to the projecting direction of the head part and orthogonal to the first swing axis, the second link mechanism configured to support the interposer on the body part swingably about the second swing axis. Here, a distance between the first connecting axes for connection of the two first link arms to the interposer may be shorter than a distance between the first connecting axes for connection of the two first link arms to the head part. A distance between the second connecting axes for connection of the two second link arms to the body part may be shorter than a distance between the second connecting axes for connection of the two second link arms to the interposer. An intersection of a first straight line with a second straight line may be located closer to an opposite end portion, in the longitudinal direction, of the body part, than an intersection of a third straight line with a fourth straight line is, the first straight line joining the second connecting axes for one of the two second link arms, the second straight line joining the second connecting axes for the other second link arm, the third straight line joining the first connecting axes for one of the two first link arms, the fourth straight line joining the first connecting axes for the other first link arm.

According to this configuration, for example, with certain arrangement of the first link arms and the second link arms, it is possible to obtain, in a relatively simple manner, a configuration which allows the head part to swing about the first and second swing axes by the first and second link mechanisms, and which also increases the swing (slide) resistance of the head part generated when the head part swings about the second swing axis.

Two of first link mechanisms may be provided and separated from each other in the longitudinal direction of the shaving portion. A shaft configured to rotatably support the head part may be bridged between a first link arm of one of the two first link mechanisms and a first link arm of the other first link mechanism. Two longitudinal end portions of the shaft may be fixed to the corresponding first link aims of the respective two first link mechanisms. A longitudinal center portion of the shaft may be fixed to the head part.

According to this configuration, when the head part swings about the first swing axis, the shaft twists and thus generates a reactive force (torque) against the swing. Hence, it is possible to obtain swing load torque with a relatively simple configuration.

Two of first link mechanisms may be provided and separated from each other in the longitudinal direction of the shaving portion. The two first link mechanisms may be provided independently of each other. Each pair of the first connecting axes corresponding between the two first link mechanisms may be concentrically arranged.

According to this configuration, it is possible to form a simple configuration, as compared to a case where two first link mechanisms are formed integratedly.

The first link mechanism may include a first support arm configured to rotatably support the two first link arms. The first support arm may include an attachment having a flat portion intersecting with an imaginary plane orthogonal to the first swing axis. The attachment may be fixed to the interposer with the flat portion placed against the interposer.

According to this configuration, the portions where the flat portions abut against the interposer receive a force caused by a swing of the head part and acting on the attachment portions of the first support arms. Consequently, misalignment of the first support arms from the interposer due to the swing of the head part is suppressed, and thus the support stiffness of the interposer for the first support arms is easily secured.

The second link mechanism may include a base and paired second support arms projecting respectively from two sides, in a direction of the second swing axis, of the base. Each of the two second link arms may be bridged rotatably between the paired second support arms.

According to this configuration, the second link mechanism is formed spatially, which helps to increase the stiffness and strength thereof.

Each of the two second link arms may be bridged in a U shape between the paired second support arms. The interposer may be attached to a bottom portion of the U shape of each of the two second link arms.

According to this configuration, it is possible to obtain a configuration which is relatively simple but still allows the two second link arms to be connected to the interposer concentrically and rotatably.

The electric shaver may further comprise an elastic member configured to apply a reactive force against a swing of the interposer with respect to the body part. Here, the elastic member may be bridged between the body part and the interposer from one side to another side in the direction of the second swing axis.

According to this configuration, it is possible to secure a necessary reactive force against swing about the second swing axis, and thus to further prevent the head part from swinging easily only about the second swing axis. In addition, a sufficient length of the elastic member can be secured easily, which in turn allows a high flexibility in setting the level of the reactive force against swing.

The electric shaver may further comprise: a first biasing mechanism configured to apply a reactive force against a swing of the head part with respect to the interposer; and a second biasing mechanism configured to apply a reactive force against a swing of the interposer with respect to the body part. Here, torque obtained by the reactive force from the second biasing mechanism may be larger than torque obtained by the reactive force from the first biasing mechanism.

According to this configuration, it is possible to further prevent the head part from swinging easily only about the second swing axis Ax. Consequently, a further improved following performance of the head part on a shaving area can be exerted.

DETAILED DESCRIPTION OF THE EMBODIMENT

Figure 1:
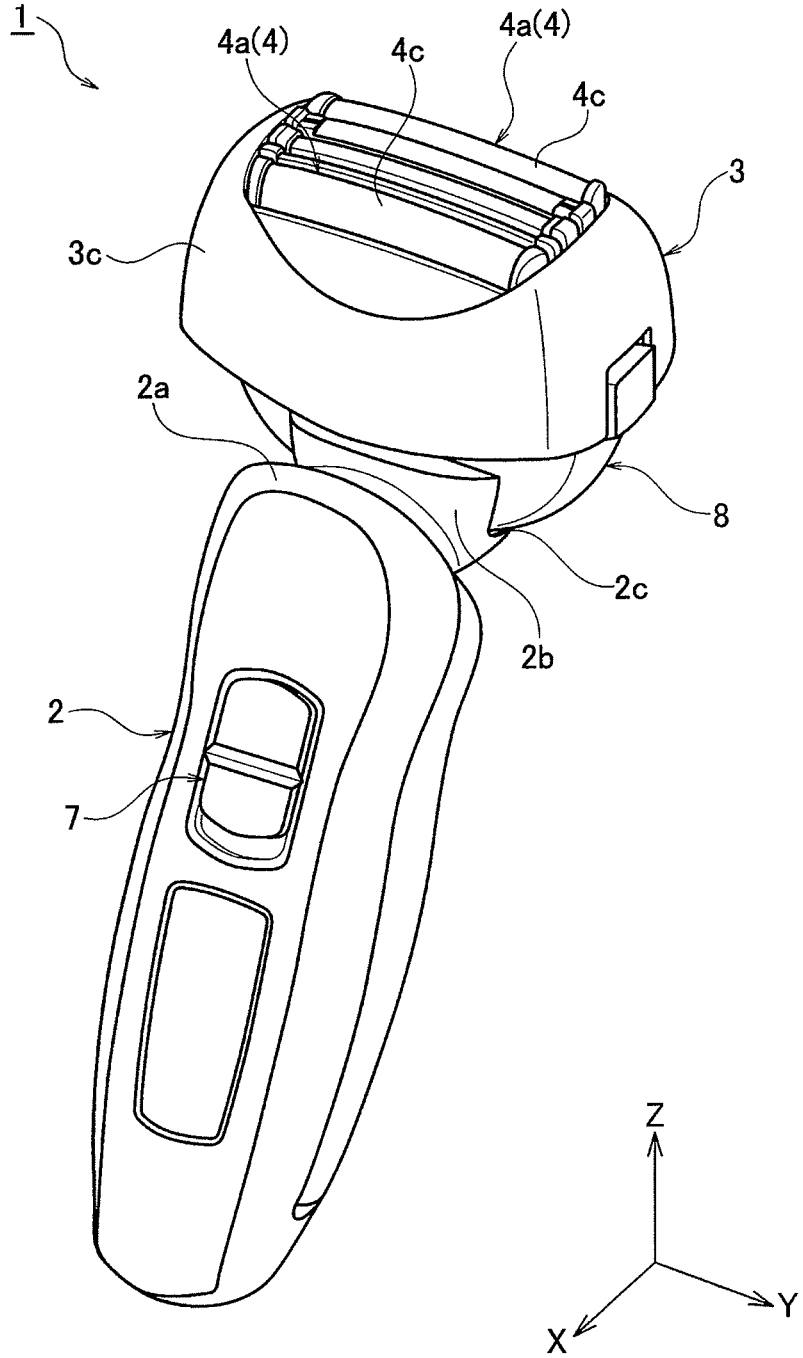
FIG. 1 is a perspective view of an electric shaver according to an embodiment of the present invention.

Hereinbelow, an embodiment of the present invention will be described in detail with reference to the drawings. Note that similar components are included in the following embodiment and its modifications, and therefore will be denoted below by common reference characters and duplicate description thereof will be omitted. In addition, in the following, an X direction, a Y direction, and a Z direction in the drawings will be referred to a front-to-rear direction, a right-to-left direction, and a top-to-bottom direction, respectively, for convenience of explanation.

As shown in FIG. 1, an electric shaver 1 according to the embodiment of the present invention includes a rod-shaped body part 2 and a head part 3 swingably attached to an end portion 2*a* on one longitudinal side (the upper side of FIG. 1) of the body part 2.

Figure 2:
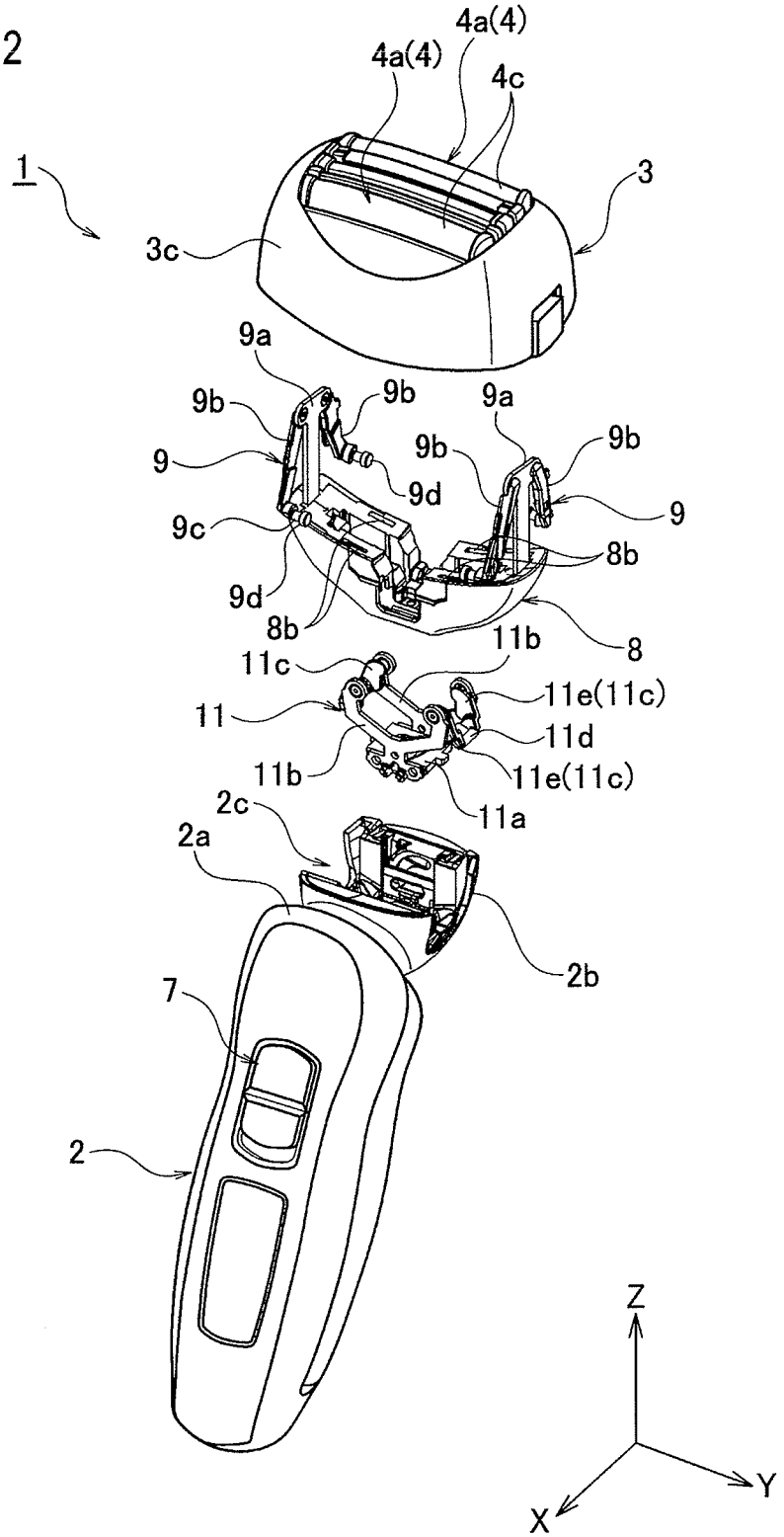
FIG. 2 is an exploded perspective view of the electric shaver according to the embodiment of the present invention.

In this embodiment, as shown in FIGS. 1 and 2, a projecting portion 2*b* which is expanded laterally (in the X direction) is formed at the end portion 2*a* on the one longitudinal side of the body part 2. The head part 3 is attached to the projecting portion 2*b*. The head part 3 projects from the body part 2 in the Z direction in FIGS. 1 and 2 (=a projecting direction, or the upper side of FIGS. 1 and 2) while being in a free state; i.e., no swinging force is acting thereon.

Figure 3:
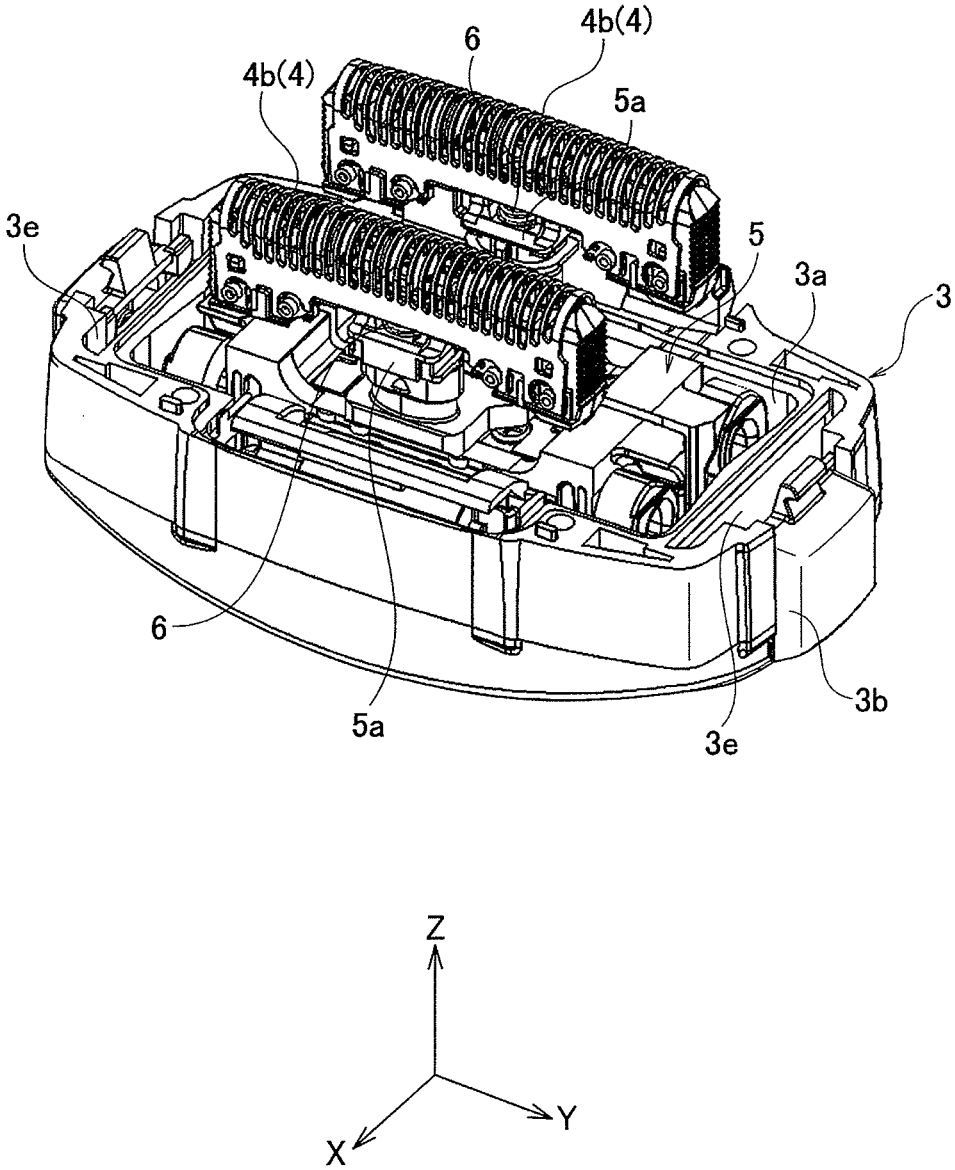
FIG. 3 is a perspective view of a head part of the electric shaver according to the embodiment of the present invention, and shows the head part with an outer case removed therefrom.

As shown in FIGS. 2 and 3, the head part 3 is provided with multiple (two in this embodiment) shaving portions 4 which are elongated in one direction (the Y direction) approximately orthogonal to the projecting direction (the Z direction) and which are parallel with each other. Each of the shaving portions 4 includes, as paired blades, an outer blade 4*a* (FIG. 2)

which is exposed at the tip of the head part 3 and is formed in a mesh pattern, and an inner blade 4*b* (FIG. 3) which is configured to reciprocate in sliding contact with the inner surface of the outer blade 4*a*. The shaving portion 4 is configured so that hair let in the shaving portions 4 via openings in the mesh pattern of the outer blade 4*a* would be cut between the inner surface of the outer blade 4*a* and the outer surface of the inner blade 4*b*. The outer surfaces of the outer blades 4*a* serve as contact surfaces 4*c*. In this embodiment, each outer blade 4*a* is fixed to the head part 3, whereas each inner blade 4*b* is configured to be reciprocally driven in a longitudinal direction of its shaving portion 4 (i.e., the Y direction) by a drive mechanism 5 configured for example as a linear motor. This configuration allows a relative action by a pair of the outer blade 4*a* and the inner blade 4*b*, which in turn produces the above cutting function. Note that, in this embodiment, the two inner blades 4*b* are configured to reciprocate in opposite phases in the Y direction.

The head part 3 includes a head case 3*b* (FIG. 3) having a concave portion 3*a* in the shape of a bottomed square cylinder and an outer case 3*c* (FIG. 2) configured to cover the opening side of the head case 3*b*. The drive mechanism 5 is housed in the concave portion 3*a*. The inner blades 4*b* are attached to movable portions 5*a* of the drive mechanism 5, respectively, whereas the outer blades 4*a* are attached to the outer case 3*c*. The inner blades 4*b* are pressed against the respective outer blades 4*a* from the inside (the lower side of FIGS. 2 and 3) when the outer case 3*c* having the outer blades 4*a* attached thereto are brought to cover and be attached to the head case 3*b* having the drive mechanism 5 and the inner blades 4*b* attached thereto. Incidentally, appropriate pressing forces can be applied between the inner blades 4*b* and the outer blades 4*a* by biasing mechanisms 6, such for example as coil springs, attached to the movable portions 5*a*, respectively.

As shown in FIGS. 1 and 2, an operation part 7 is provided on a surface of the body part 2. The user's manipulation of the operation part 7 allows switching between actuation and deactuation of the drive mechanism 5. The body part 2 houses a battery as a power source of the drive mechanism 5, a converter configured to convert an AC power to a DC power, a drive circuit configured to drive the drive mechanism 5, and the like. To shave hair, such as a beard, the user activates the drive mechanism 5, by manipulating the operation part 7, to thus reciprocate the inner blades 4*b*; and moves the electric shaver 1 along a skin (shaving area) while holding the body part 2 and pressing the contact surfaces 4*c* of the outer blades 4*a* at the tip of the head part 3 against the skin.

Figure 4:
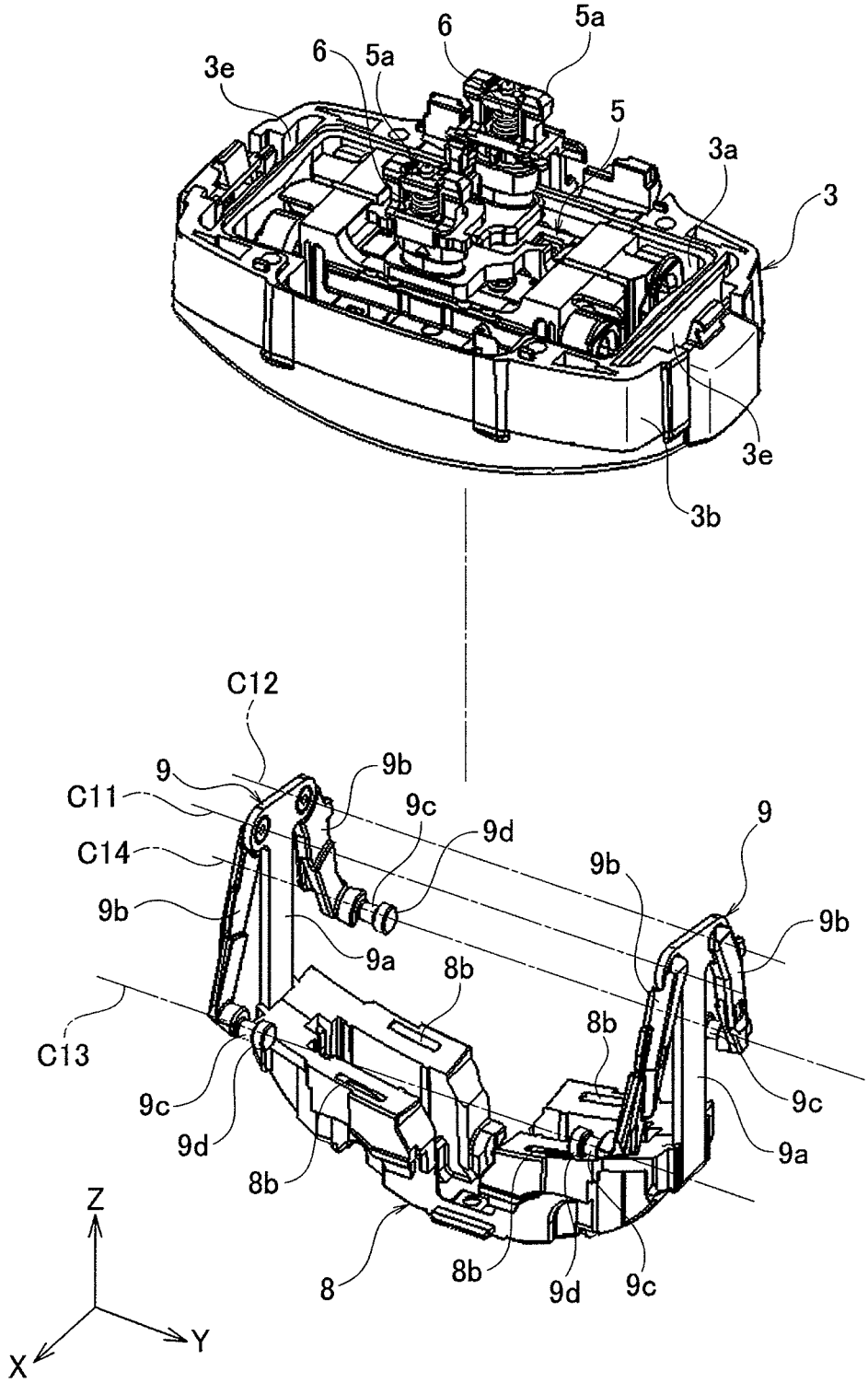
FIG. 4 is an exploded perspective view showing an interposer, first link mechanisms, and part of the head part, all of which are included in the electric shaver according to the embodiment of the present invention.

In this embodiment, as shown in FIGS. 2, 4, and so on, an interposer 8 is provided between the body part 2 and the head part 3. The interposer 8 is configured to be swingably supported by the body part 2 and also to swingably support the head part 3. Specifically, the interposer 8 supports the head part 3 swingably about a first swing axis Ay (FIG. 7, etc.) approximately parallel with the longitudinal direction of the shaving portions 4 (i.e., the Y direction). Moreover, the interposer 8 is supported by the body part 2 (FIG. 7, etc.) swingably about a second swing axis Ax which is approximately orthogonal to the projecting direction of the head part 3 (i.e., the Z direction) and also extends in a direction (the X direction) orthogonal to the first swing axis Ay.

Figure 8:
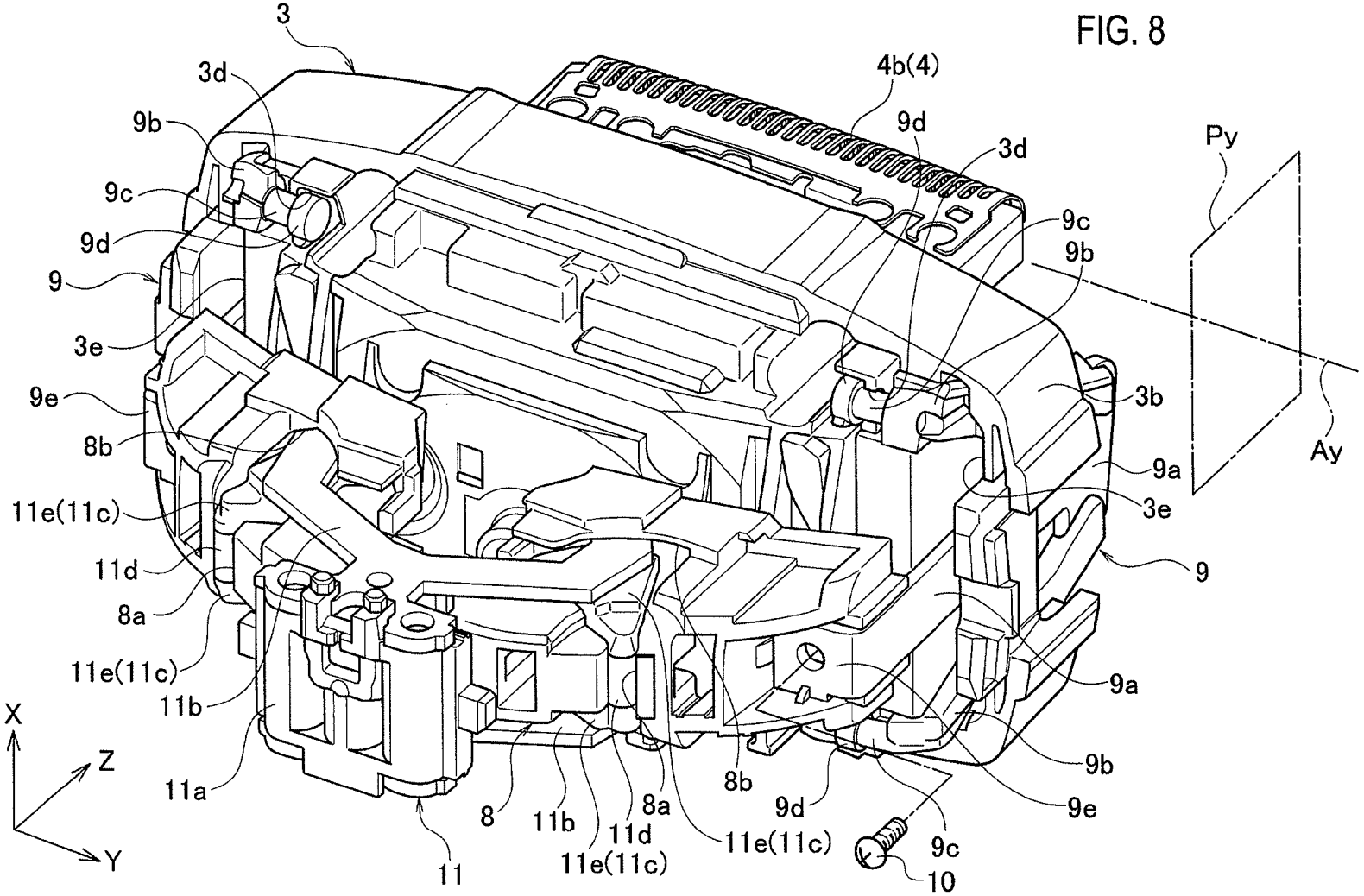
FIG. 8 is a perspective view (a view seen from a body part side in a Z direction) showing the second link mechanism, the interposer, the first link mechanisms, and part of the head part, all of which are included in the electric shaver according to the embodiment of the present invention.

The head part 3 is supported by the interposer 8 with first link mechanisms 9 therebetween. As shown in FIGS. 2, 4, and so on, there are provided two first link mechanisms 9 which are separated in the longitudinal direction of the shaving portions 4 (i.e., the Y direction). Each of the first link mechanisms 9 includes: an approximately T-shaped first support arm 9*a* which is fixed to an end portion, in the Y direction, of the interposer 8 and projects in the Z direction; and two first link arms 9*b* which are rotatably connected to one Z-direction side (a side closer to the tip of the head part 3, or the upper side of FIG. 4) of the first support arm 9*a*, and which are separated in the X direction. An approximately-cylindrical protrusion 9*c* projecting toward the center, in the Y direction, of the head part 3 is provided to the other Z-direction side (a side closer to the body part 2, or the lower side of FIG. 4) of each first link arm 9*b*. The protrusion 9*c* is provided with an enlarged diameter portion 9*d*. As shown in FIG. 8, receivers 3*d* are formed on the other Z-direction side (a near side of FIG. 8) of the head part 3. Each receiver 3*d* is in a concavoconvex shape (a stepped, semicylindrical concave portion, for example) corresponding to the protrusion 9*c* and the enlarged diameter portion 9*d*. The protrusion 9*c* and the enlarged diameter portion 9*d* as well as the receiver 3*d* are configured in such a way that the protrusion 9*c* and the enlarged diameter portion 9*d* can be fitted into the receiver 3*d* while at least one of the protrusion 9*c* and the enlarged diameter portion 9*d* or the receiver 3*d* is elastically deformed and mutually approaches each other in the Z direction. In this embodiment, the fitted state of these portions allows the protrusion 9*c* and the enlarged diameter portion 9*d* to be supported by the receiver 3*d* rotatably about the Y direction. In other words, in this embodiment, each of the first link arms 9*b* is rotatably connected to both the interposer 8 and the body part 2.

As shown in FIG. 4, the two first link mechanisms 9 have symmetrical configurations on the right and left sides. Thus, the first link arms 9*b* are disposed so that each pair of connecting axes C11 to C14 corresponding between the two right and left first link mechanisms 9 can be concentric. Here, the connecting axes C11 to C14 extend in the Y direction and are used for connection of the first link arms 9*b* to the interposer 8 or the body part 2.

Figure 6:
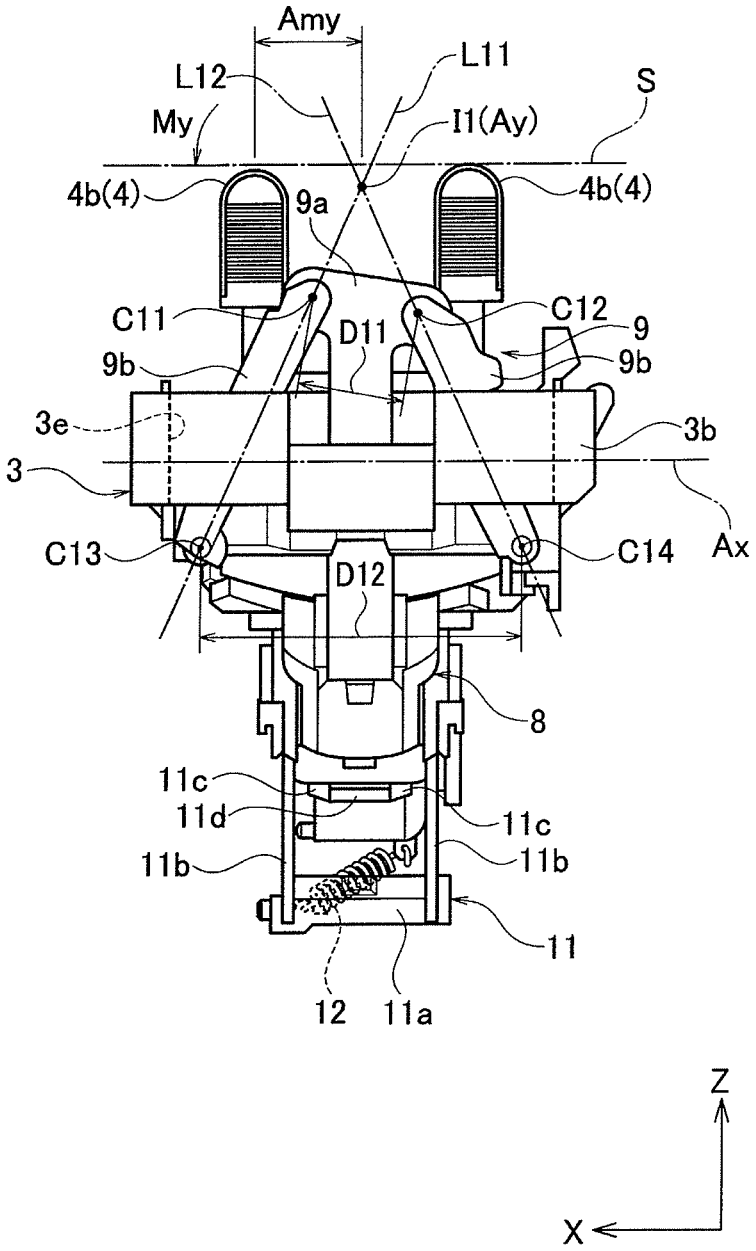
FIG. 6 is a side view (a view seen from a Y direction) showing the second link mechanism, the interposer, the first link mechanisms, and part of the head part, all of which are included in the electric shaver according to the embodiment of the present invention.

Thus, in this embodiment, as shown in FIG. 6, the first link mechanisms 9 form a planar four-link mechanism in which the head part 3 and the interposer 8 (or the first support arms 9*a* fixed thereto) are rotatably connected to the two first link arms 9*b* in four portions at the four connecting axes C11 to C14 extending in the Y direction.

As shown in FIG. 6, in this embodiment, a distance D11 between the connecting axes C11 and C12 for connection of the link arms 9*b* to the interposer 8 (the first support arm 9*a* fixed to the interposer 8 in this embodiment) is made shorter than a distance D12 between the connecting axes C13 and C14 for connection of the first link arms 9*b* to the head part 3. Further, when viewed in the Y direction (i.e., in the view of FIG. 6), each of the first link mechanisms 9 is configured so that an intersection I1 of a straight line L11 (which joins the connecting axes C11 and C13 for one of the first link arms 9*b*) with a straight line L12 (which joins the connecting axes C12 and C14 for the other first link arm 9*b*) can be located near the position of a tip portion S (indicated by a chain line in FIGS. 6 and 7), in the projecting direction (the Z direction), of the contact surface 4*c* of the outer blade 4*a* of each shaving portion 4 disposed on the side closer to the tip, in the Z direction, of the head part 3. In this configuration, the intersection I1 may be considered as the first swing axis Ay in the state shown in FIG. 6 (the free state).

In each of the first link mechanisms 9 according to this embodiment, the distance D11 is set shorter than the distance D12 as mentioned above. If they were set equal to each other, the first link mechanism would be parallelogram, which permits only parallel movement of the contact surfaces 4*c* of the head part 3 and thus makes it impossible to obtain a swing action. Meanwhile, if the distance D11 were set longer than the distance D12, the first swing axis Ay would get away from the contact surfaces 4*c*. This causes the contact surfaces 4*c* to slide on a shaving area when the head part 3 swings, which increases the swing resistance. That is to say, in this embodiment, by setting the distance D11 shorter than the distance D12, a smoother swing action about the first swing axis Ay is obtained.

In this embodiment, as shown in FIGS. 3, 4, 6, 8, and so on, thin slits 3*e* are formed respectively in both end portions, in the Y direction, of the head case 3*b* so as to penetrate in the Z direction and be approximately orthogonal to the Y direction. The first support arms 9*a* and the first link arms 9*b* can be inserted into the slits 3*e* from the other Z-direction side (from the lower side of FIGS. 4 and 6), thereby to penetrate the head case 3*b* in the Z direction. This configuration implements the above-described layout (see FIG. 6) in which the connecting axes C11 and C12 for connection to the interposer 8 are located closer to the one Z-direction side (the side closer to the tip of the head part 3) than the connecting axes C13 and C14 for connection to the head part 3 are to thus dispose the intersection I1 (the first swing axis Ay) near the tip portion S, in the projecting direction (the Z direction), of each contact surface 4*c*. This configuration also makes it possible to improve the assemblability of the first link mechanisms 9.

In this embodiment, as shown in FIG. 8, each of the first support arms 9*a* is provided with an attachment 9*e* having a flat portion (a rear surface of the attachment 9*e* in the view of FIG. 8) which intersects with (or, in this embodiment, is orthogonal to) an imaginary plane Py (see the XZ plane in FIG. 8) orthogonal to the first swing axis Ay. With the flat portions abutting against the interposer 8, the attachments 9*e* are fixed to the interposer 8 with screws 10. This configuration allows the portions (where the flat portions abut against the interposer 8) to receive a force caused by the swing of the head part 3 and acting on the attachment portions of the first support arms 9*a*. Consequently, misalignment of the first support arms 9*a* from the interposer 8 due to the swing is suppressed. Moreover, even if the first support arms 9*a* are fixed with the screws 10, it is possible to suppress loosening of the screws 10 due to the swing of the head part 3.

Figure 5:
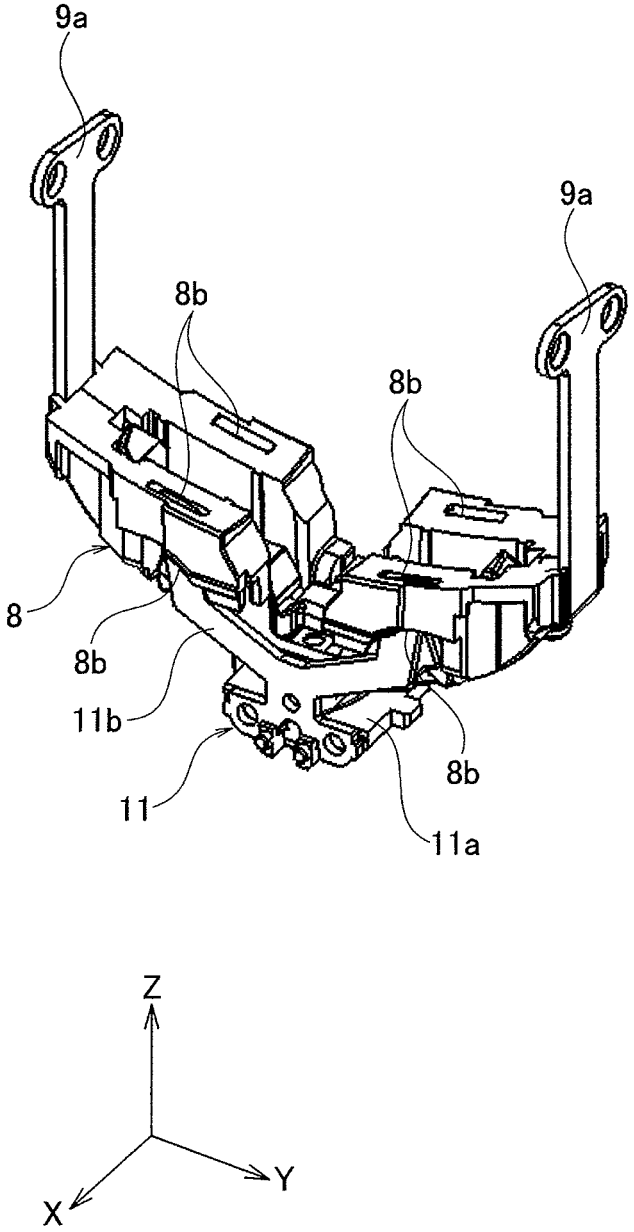
FIG. 5 is a perspective view showing a second link mechanism, the interposer, and part of the first link mechanisms, all of which are included in the electric shaver according to the embodiment of the present invention.

The interposer 8 is supported by the body part 2 with a second link mechanism 11 therebetween. As shown in FIG. 2, the second link mechanism 11 is, for example, screwed or fitted to, in other words, fixed to the projecting portion 2*b* while being housed inside a concave portion 2*c* formed in the projecting portion 2*b* of the body part 2. Moreover, as shown in FIGS. 2, 5, 8, and so on, the second link mechanism 11 includes: a base 11*a* in the shape of an approximately-rectangular flat plate; two second support arms 11*b* projecting in approximately Y-shapes toward the one Z-direction side (the side closer to the tip of the head part 3) respectively from both end portions, in the X direction, of the base 11*a*; and two second link arms 11*c* bridged between the two second support arms 11*b*. The two second link arms 11*c* are disposed away from each other in the Y direction and connected to the second support arms 11*b* respectively so as to be rotatable about connecting axes C 21 and C22 extending in the X direction (FIG. 7).

The second link arms 11*c* are each formed in an approximately U-shape when viewed in the Y direction. Portions of each second link arm 11*c* on the opening side of the U shape are rotatably supported by the second support arms 11*b*, respectively, whereas the interposer 8 is rotatably attached to a bottom portion 11*d* of the U shape. In this embodiment, the bottom portion 11*d* in an approximately cylindrical shape is bridged between a pair of side portions 11*e* of each second link arm 11*c* so as to be rotatable about the axis thereof. Also, the bottom portion 11*d* is fitted and thus attached to a receiver 8*a* formed as an approximately-cylindrical concave portion in a bottom portion of the interposer 8, by bringing the bottom portion 11*d* closer to the receiver 8*a* from the other Z-direction side (the near side of FIG. 8). In other words, in this embodiment, the central axes of the bottom portions 11*d* serve respectively as connecting axes C23 and C24 (FIG. 7) extending in the X direction.

Figure 7:
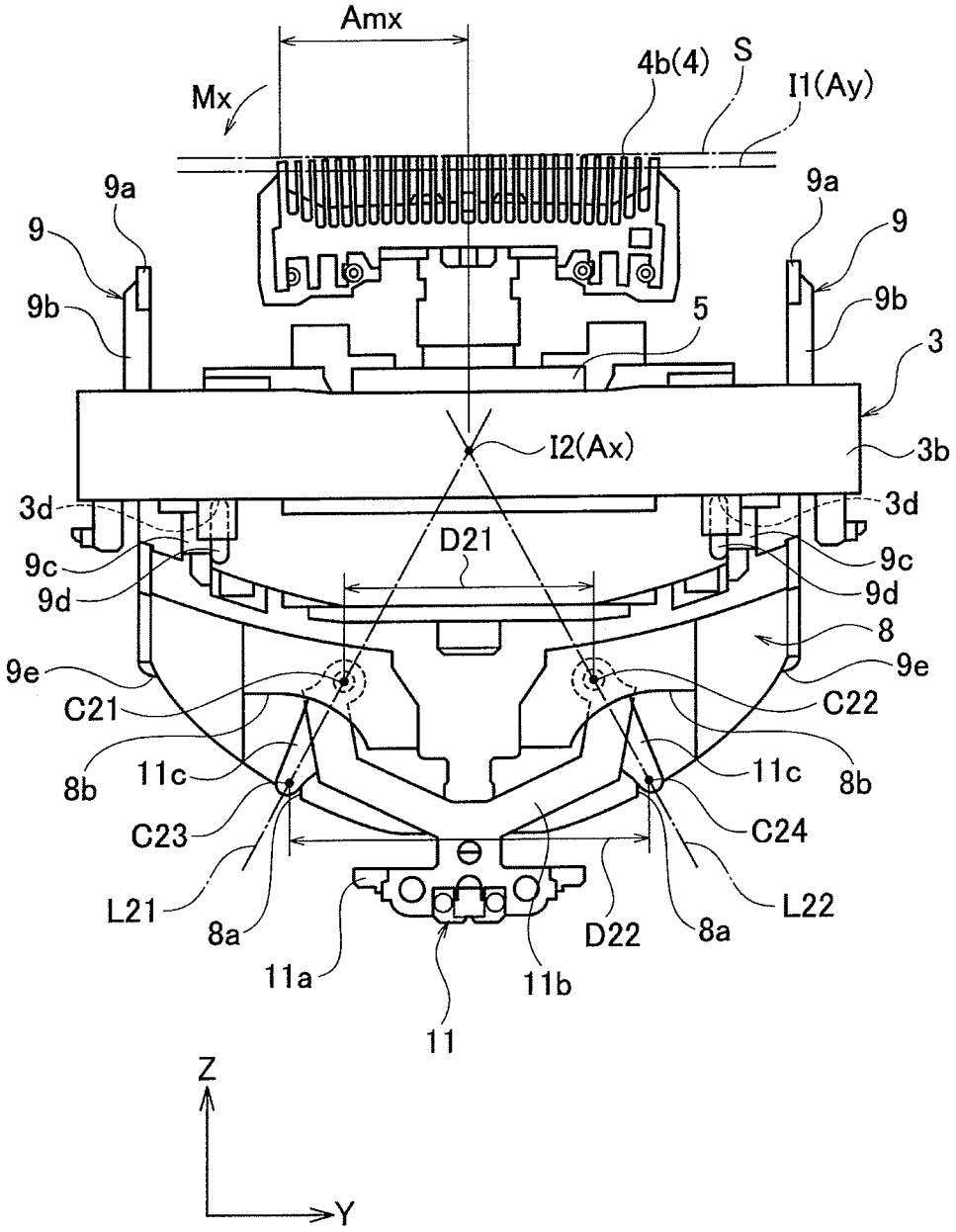
FIG. 7 is a front view (a view seen from an X direction) showing the second link mechanism, the interposer, the first link mechanisms, and part of the head part, all of which are included in the electric shaver according to the embodiment of the present invention.

Thus, in this embodiment, as shown in FIG. 7, the second link mechanism 11 forms a planar four-link mechanism in which the interposer 8 and the body part 2 (or the second support arms 11*b* fixed thereto) are rotatably connected to the two second link arms 11*c*) in four portions at the four connecting axes C21 to C24 extending in the X direction.

As shown in FIG. 7, as in the case of the first link mechanisms 9 described above, the second link mechanism 11 is also configured so that a distance D21 between the connecting axes C21 and C22 for connection of the second link arms 11*c* to the body part 2 (in this embodiment, the second support arms 11*b* fixed to the body part 2) would be shorter than a distance D22 between the connecting axes C23 and C24 for connection of the second link arms 11*c* to the interposer 8. Further, when viewed in the X direction (i.e., in the view of FIG. 7), the second link mechanism 11 is configured so that an intersection 12 of a straight line L21 (which joins the connecting axes C21 and C23 for one of the second link arms 11*c*) with a straight line L22 (which joins the connecting axes C22 and C24 for the other second link arm 11*c*) can be located farther away from the position of the tip portion S, in the projecting direction (the Z direction), of the contact surface 4*c* of the outer blade 4*a* of each shaving portion 4, than the intersection I1 for the first link arms 9*b* is. In this configuration, the intersection 12 may be considered as the second swing axis Ax in the state shown in FIG. 7 (the free state).

In other words, in this embodiment, the second swing axis Ax (the intersection 12) is located away from the tip portion S, in the projecting direction (the Z direction), of the contact surface 4*c* of each shaving portion 4, the contact surface 4*c* being to be brought into contact with a shaving area. Thus, swinging the head part 3 about the second swing axis Ax causes the contact surfaces 4*c* to move (slide) along the shaving area, hence generating swing resistance.

Here, in the electric shaver 1 having the shaving portions 4 elongated in the Y direction as described in this embodiment, a moment arm Amx (FIG. 7) of the head part 3 swinging about the second swing axis Ax is longer than a moment arm Amy (FIG. 6) of the head part 3 swinging about the first swing axis Ay. Thus, a swing torque (turning moment) Mx (FIG. 7) about the second swing axis Ax is likely to be larger than a swing torque (turning moment) My (FIG. 6) about the first swing axis Ay. This creates a situation where it is easier for the head part 3 to swing about the second swing axis Ax but difficult to swing about the first swing axis Ay, if no countermeasures are taken. This might lower the following performance of the head part 3 exerted during swing on an uneven shaving area when the head part 3 is moved along the shaving area.

Meanwhile, in this embodiment, as described above, the second swing axis Ax (the intersection 12) is located farther away from the contact surface 4*c* of each shaving portion 4, than the first swing axis Ay (the intersection I1) is, the contact surface 4*c* being to be brought into contact with the shaving area. Thus, sliding between the contact surfaces 4*c* and the shaving area due to swinging of the head part 3 increases the swing (slide) resistance of the head part 3 in swing about the second swing axis Ax, thereby preventing the head part 3 from swinging easily only about the second swing axis Ax. Consequently, an improved following performance of the head part 3 on the shaving area can be exerted.

Moreover, in this embodiment, as shown in FIG. 6, a coil spring 12 is provided between the body part 2 (or, in this embodiment, the base 11*a*) and the interposer 8, as a second biasing mechanism configured to apply a reactive force against the swing of the head part 3 with respect to the body part 2 (swing of the interposer 8 with respect to the body part 2). The coil spring 12 is an elastic member bridged from one side to the other side in the direction of the second swing axis Ax. This coil spring 12 makes it possible to secure a necessary reactive force against the swing about the second swing axis Ax, and thus to further prevent the head part 3 from swinging easily only about the second swing axis Ax. In addition, the disposition of the coil spring 12 in the direction of the second swing axis Ax helps to secure a sufficient length of the coil spring 12, which in turn allows a high flexibility in setting the level of the reactive force against swing.

In this embodiment, the coil spring 12 as the second biasing mechanism is attached between the base 11*a* and the interposer 8. It is therefore possible to obtain the state where the second biasing mechanism is interposed between the body part 2 and the interposer 8 by attaching the coil spring 12 at the time of assembling the second link mechanism 11 and the interposer 8 together, and then by fixing the assembly (of the base 11*a* of the second link mechanism 11) to the body part 2. Such a configuration can reduce the amount of work required for the attachment, as compared with the case of directly installing the second biasing mechanism between the body part 2 and the interposer 8.

In this embodiment, as shown in FIGS. 2, 4, 5, 7, 8, and so on, slits 8*b* are formed in the interposer 8 also as in the case of the above-described first link mechanisms and head case 3*b*. Into the slits 8*b*, the second support arms 11*b* and the second link arms 11*c* are inserted. The slits 8*b* are configured in such a way to allow the second support arms 11*b* and the second link arms 11*c* to be inserted therethrough from the other Z-direction side (from the lower side of FIGS. 4, 5, and 7) and thereby to penetrate the interposer 8 in the Z direction. This configuration implements the above-described layout (FIG. 6) in which the connecting axes C11 and C12 for connection to the interposer 8 are located closer to the one Z-direction side (the side closer to the tip portion of the head part 3) than the connecting axes C13 and C14 for connection to the head part 3 are to thus dispose the intersection I1 (the first swing axis Ay) near the contact surfaces 4*c*. The configuration also makes it possible to improve the assemblability of the first link mechanisms 9.

As has been described above, in this embodiment, the second swing axis Ax is located farther away from the tip portion S, in the projecting direction (the Z direction), of the contact surface 4*c* of each shaving portion 4, than the first swing axis Ay is, the contact surface 4*c* being to be brought into contact with the shaving area. Thus, when the head part 3 swings about the second swing axis Ax, the contact surfaces 4*c* move (slide) a longer distance along the shaving area, which increases the swing resistance. Specifically, in the case where the head part 3 swings about the second swing axis Ax, the swing torque My becomes larger as the moment arm Amy becomes longer; however, the swing load torque can be increased by the slide resistance, thereby preventing the head part 3 from swinging easily only about the second swing axis Ax. Consequently, an improved following performance of the head part 3 on the shaving area can be exerted.

In this embodiment, the head part 3 is supported on the interposer 8 with the first link mechanisms 9 therebetween so as to be swingable about the first swing axis Ay, and the interposer 8 is supported on the body part 2 with the second link mechanism 11 therebetween so as to be swingable about the second swing axis Ax. Accordingly, for example, with certain arrangement of the first link arms 9*b* and the second link arms 11*c* (the positions of the connecting axes and the angles of the link arms, for example), it is possible to obtain, in a relatively simple manner, a configuration which allows the head part 3 to swing about the first and second swing axes Ay and Ax, and which also increases the swing (slide) resistance of the head part 3 generated when the head part 3 swings about the second swing axis Ax.

In this embodiment, the first link mechanisms 9 are configured in such a way that: two first link mechanisms 9 are provided and separated from each other in the Y direction; each pair of the connecting axes C11 to C14 corresponding between the two first link mechanisms 9 is concentrically arranged; and the respective two first link mechanisms 9 are separated into two parts. Accordingly, it is possible to form a simple configuration, as compared to a case where two first link mechanisms 9 are formed integratedly.

In this embodiment, the first support arm 9*a* of each first link mechanism 9 is provided with the attachment 9*e* having the flat portion which intersects with the imaginary plane Py orthogonal to the first swing axis Ay. With the flat portions abutting against the interposer 8, the attachments 9*e* are fixed to the interposer 8. Thereby, the portions where the flat portions abut against the interposer 8 receive a force caused by the swing of the head part 3 and acting on the attachment portions of the first support arms 9*a*. Consequently, misalignment of the first support arms 9*a* from the interposer 8 due to the swing of the head part 3 is suppressed, and thus the support stiffness of the interposer 8 for the first support arms 9*a* is easily secured.

In this embodiment, the second link mechanism 11 is configured to include the base 11*a*, the paired second support arms 11*b*, and the two second link arms 11*c* bridged between the paired second support arms 11*b*. This allows the second link mechanism 11 to be formed spatially and thus helps to increase the stiffness and strength thereof. In addition, the amount of assembly work can be reduced, as compared to the case where second link mechanisms 11 are provided separately in the X direction.

In this embodiment, the two second link arms 11*c* are each bridged in an approximately U-shape between the paired second support arms 11*b*, and the interposer 8 is attached to the bottom portion 11*d* of the approximately U shape. This makes it possible to obtain a configuration which is relatively simple but still allows the two second link arms 11*c* to be connected to the interposer 8 concentrically and rotatably. In addition, the amount of assembly work can be reduced.

In this embodiment, the coil spring 12 is provided between the body part 2 and the interposer 8, as the second biasing mechanism configured to apply a reactive force against the swing of the head part 3 with respect to the body part 2. The coil spring 12 is an elastic member bridged from one side to the other side in the direction of the second swing axis Ax. Accordingly, it is possible to secure a necessary reactive force against the swing about the second swing axis Ax, and thus to further prevent the head part 3 swinging easily only about the second swing axis Ax. In addition, a sufficient length of the coil spring 12 can be secured easily, which in turn allows a high flexibility in setting the level of the reactive force against swing.

(Modification)

Figure 9:
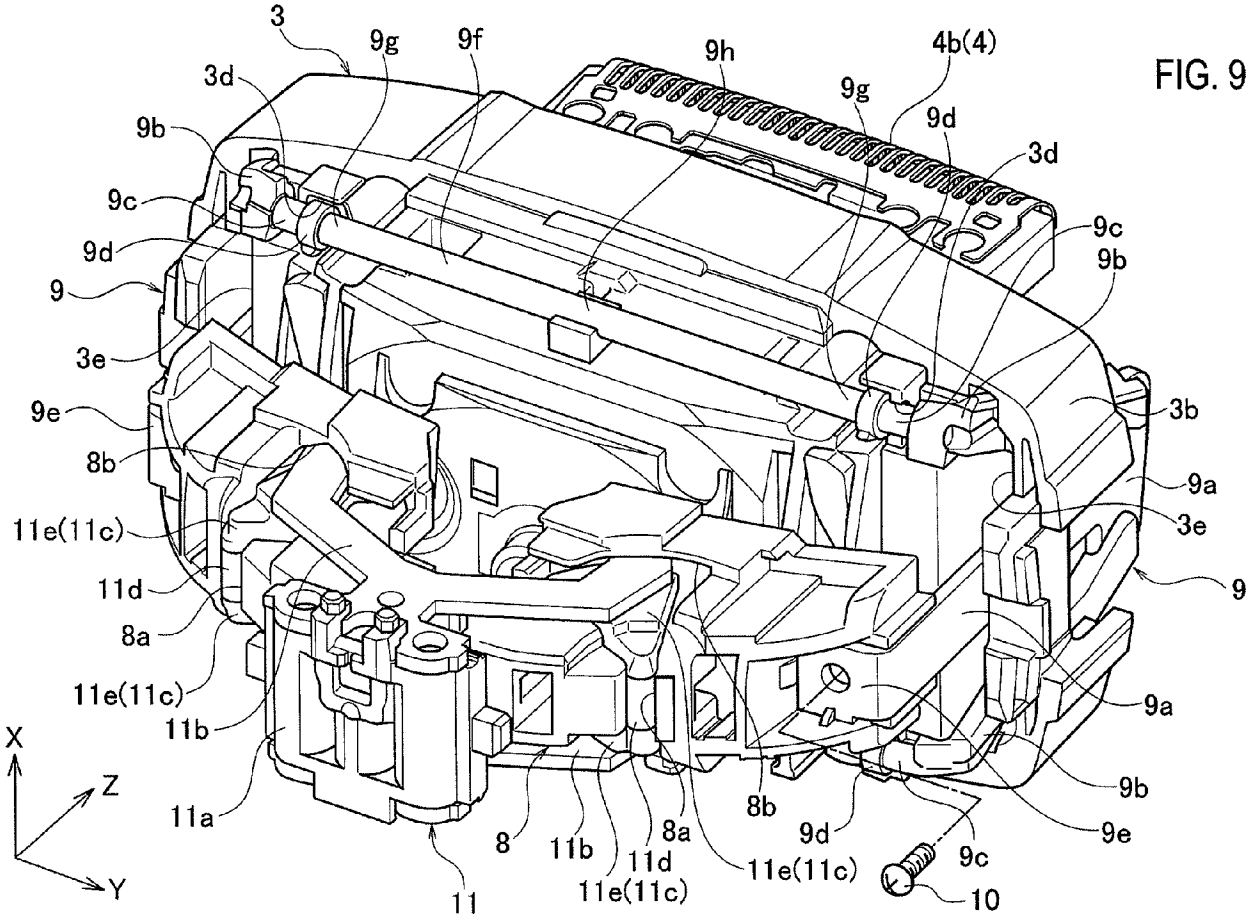
FIG. 9 is a perspective view (a view seen from the body part side in the Z direction) showing the second link mechanism, the interposer, the first link mechanisms, and part of the head part, all of which are included in an electric shaver according to a modification of the embodiment of the present invention.

In a modification of the above-described embodiment, as shown in FIG. 9, a shaft 9*f* configured to rotatably support the head part 3 is bridged between the first link arm 9*b* of one of the two first link mechanisms and the first link arm 9*b* of the other one of the first link mechanisms 9 that are separated from each other in the Y direction. Moreover, two longitudinal end portions 9*g* of the shaft 9*f* are fixed to the first link arms 9*b*, respectively. Furthermore, a longitudinal center portion 9*h* of the shaft 9*f* is fixed to the head part 3. The two longitudinal end portions 9*g* respectively have the similar shape to or the same shape as the protrusions 9*c* and the enlarged diameter portions 9*d* of the above-described embodiment. Thus, the two longitudinal end portions 9*g* are supported by the receivers 3*d* so as to be rotatable about the Y direction. Meanwhile, the longitudinal center portion 9*h* is fixed, for example, by being fitted, welded, bonded, or screwed to the head part 3. For this reason, the shaft 9*f* functions as a torsion bar configured to twist between the longitudinal center portion 9*h* and each of the two longitudinal end portions 9*g*. When the head part 3 swings about the first swing axis Ay, the shaft 9*f* twists and thus provides a reactive force (torque) against swing. In other words, according to this modification, it is possible to obtain swing load torque about the first swing axis Ay with a relatively simple configuration. The shaft 9*f* corresponds to a first biasing mechanism configured to apply a reactive force against the swing of the head part 3 with respect to the interposer 8.

In such a configuration, it is preferable that the reactive torque about the second swing axis Ax generated by the coil spring 12 as the second biasing mechanism be set greater than the reactive torque about the first swing axis Ay generated by the shaft 9*f* as the first biasing mechanism. By doing so, it is possible to further prevent the head part 3 from swinging easily only about the second swing axis Ax. Consequently, a further improved following performance of the head part 3 on the shaving area can be exerted.

One embodiment of the present invention has been described above, but the present invention is not limited to the above embodiment, and various modifications are possible.

For example, in the above embodiment, a configuration is illustrated in which the head part is supported on the interposer with the first link mechanisms therebetween, and the interposer is supported on the body part with the second link mechanism therebetween; however, mechanisms other link mechanisms may be employed as the swing support mechanisms. Also, the specifications (such as the positions, sizes, or configurations) of the first link mechanisms and second link mechanism are not limited to the ones in the above embodiment.

In addition, mechanisms or members other than a coil spring and a torsion bar (a shaft) may be employed as the first and second biasing mechanisms.

What is claimed is:

1. An electric shaver comprising:

a body;

a head swingably attached to one end portion, of the body along a longitudinal axis, of the body of the electric shaver, the head including a shaving mechanism and a drive mechanism, the shaving mechanism being elongated along a transverse axis orthogonal to the longitudinal axis in which the head projects and having a plurality of pairs of an inner blade and an outer blade arranged in rows along a lateral axis orthogonal to the longitudinal and transverse axes, the drive mechanism being configured and drivingly coupled to cause a relative movement between the inner blade and the outer blade of each of the plurality of pairs; and an interposer configured to support the head swingably about a first swing axis parallel with the transverse axis, and to be supported on the body swingably about a second swing axis orthogonal to the longitudinal axis and orthogonal to the first swing axis, wherein the first swing axis is located, along the lateral axis, between tip portions, along the longitudinal axis, of the outer blades of the plurality of pairs in rows at one end and the other end of the rows along the lateral axis, and wherein the second swing axis is located farther away from the tip portions, along the longitudinal axis than the first swing axis is.

2. The electric shaver according to claim 1, further comprising:

a first link mechanism including two first link arms each connected to the interposer and the head respectively at first connecting axes parallel with the transverse axis, the first link mechanism configured to support the head on the interposer swingably about the first swing axis; and a second link mechanism including two second link arms each connected to the body and the interposer respectively at second connecting axes orthogonal to the longitudinal axis and orthogonal to the first swing axis, the second link mechanism configured to support the interposer on the body swingably about the second swing axis, wherein a distance between the first connecting axes for connection of the two first link arms to the interposer is shorter than a distance between the first connecting axes for connection of the two first link arms to the head, a distance between the second connecting axes for connection of the two second link arms to the body is shorter than a distance between the second connecting axes for connection of the two second link arms to the interposer, and an intersection of a first straight line with a second straight line is located closer to an opposite end portion, along the longitudinal axis, of the body, than an intersection of a third straight line with a fourth straight line is, the first straight line joining the second connecting axes for one of the two second link arms, the second straight line joining the second connecting axes for the other second link arm, the third straight line joining the first connecting axes for one of the two first link arms, the fourth straight line joining the first connecting axes for the other first link arm.

3. The electric shaver according to claim 2, wherein two of the first link mechanisms are provided and separated from each other along the transverse axis, a shaft configured to rotatably support the head part is bridged between a first link arm of one of the two first link mechanisms and a first link arm of the other first link mechanism, two longitudinal end portions of the shaft are fixed to corresponding first link arms of respective two of the first link mechanisms, and a longitudinal center portion of the shaft is fixed to the head.

4. The electric shaver according to claim 2, wherein two of first link mechanisms are provided and separated from each other along the transverse axis, the two first link mechanisms are provided independently of each other, and each pair of the first connecting axes corresponding between the two first link mechanisms is concentrically arranged.

5. The electric shaver according to claim 2, wherein the first link mechanism includes a first support arm configured to rotatably support the two first link arms, the first support arm includes an attachment having a flat portion intersecting with an imaginary plane orthogonal to the first swing axis, and the attachment is fixed to the interposer with the flat portion positioned against the interposer.

6. The electric shaver according to claim 2, wherein the second link mechanism includes a base and paired second support arms projecting respectively from two sides, in a direction of the second swing axis, of the base, and each of the two second link arms is bridged rotatably between the paired second support arms.

7. The electric shaver according to claim 6, wherein each of the two second link arms is bridged in a U shape between the paired second support arms, and the interposer is attached to a bottom portion of the U shape of each of the two second link arms.

8. The electric shaver according to claim 6, further comprising an elastic member configured to apply a reactive force against a swinging of the interposer with respect to the body, wherein the elastic member is bridged between the body and the interposer from one side to another side in the direction of the second swing axis.

9. The electric shaver according to claim 2, further comprising:

a first biasing mechanism configured to apply a reactive force against swinging of the head with respect to the interposer; and a second biasing mechanism configured to apply a reactive force against swinging of the interposer with respect to the body, wherein a torque obtained by the reactive force of the second biasing mechanism is larger than a torque obtained by the reactive force of the first biasing mechanism.

* * * * *